US005732839A

United States Patent [19]

Schimmang et al.

[11] Patent Number: 5,732,839

[45] Date of Patent: Mar. 31, 1998

[54] CONTAINER

[75] Inventors: Horst Schimmang, Hurth; Klaus Gerland, Markdorf, both of Germany

[73] Assignee: M. Schall GmbH & Co. KG, Germany

[21] Appl. No.: 436,943

[22] Filed: May 8, 1995

[30] Foreign Application Priority Data

| | | | |
|---|---|---|---|
| May 9, 1994 | [DE] | Germany | 44 16 156.5 |
| Aug. 24, 1994 | [DE] | Germany | 44 29 927.3 |
| Dec. 16, 1994 | [DE] | Germany | 9420138 U |

[51] Int. Cl.[6] ..... B65D 88/00

[52] U.S. Cl. ..... 220/1.5; 220/4.03; 296/26

[58] Field of Search ..... 220/1.5, 6, 4.03; 296/26, 27

[56] References Cited

U.S. PATENT DOCUMENTS 3,719,386 3/1973 Puckett et al. ..... 296/26

FOREIGN PATENT DOCUMENTS 491328 9/1949 Belgium .
1002737 5/1991 Belgium .
1157924 9/1956 France .
1502617 4/1965 France .
63401 7/1892 Germany .
3911511 10/1990 Germany .
9408060.7 10/1994 Germany .

OTHER PUBLICATIONS

Lhotellier Montrichard; ABRI Technique Mobile Extensible, Jun., 1994.

JVJ. Vernier S.A.; Trivolume Medical Expanding Unit.

M. Schall GmbH & Co. KG; Produktinformation 10.1.

*Primary Examiner*—Joseph M. Moy
*Attorney, Agent, or Firm*—Joseph W. Berenato, III

[57] ABSTRACT

A container (1, 61, 115, 116) has a main unit (2, 62, 116, 161) and at least one additional unit (3, 4, 63, 64, 117, 118, 162) with one side which is open to the main unit (2, 62, 116, 161) whereby each additional unit (3, 4, 63, 64, 117, 118, 162) can be extended from and reeled back into the main unit (2, 62, 116, 161). In accordance with the invention there is one lift device each (44, 45, 49, 50, 107, 108, 109, 110, 111, 124, 137) through which the respective additional unit (3, 4, 63, 64, 117, 118, 162) can be lowered while or after it is extended so that the floor (10, 17, 22, 65, 70, 74, 119, 120, 121) of the main and the additional unit (2, 3, 4, 62, 63, 64, 116, 117, 118, 161, 162) are on the same level and through which the respective additional unit (3, 4, 63, 64, 117, 118, 162) can be lifted before or while it is reeled in so that it can be reeled into the main unit (2, 62, 116, 161).

30 Claims, 12 Drawing Sheets

CONTAINER

DESCRIPTION

The invention describes a container, especially containers used as working or living space, with a main unit and at least one additional unit with one side open to the main unit whereby the additional unit(s) can be extended from or reeled into the main unit.

Today portable containers are used to provide space on short notice. On the inside these containers have the equipment needed for a particular purpose, e.g. medical equipment for the treatment of injured or sick people or sleeping quarters. Such containers must not exceed certain standard measurements so that they remain portable. Additionally, the overall weight is limited so that, for example, the containers can be transported by helicopter or by plane.

In order to be able to provide as much space as possible, however, there are containers (ref. DE-A-39 11 511) which consist of a main unit and one or two additional units whereby the additional units are nested inside the main unit during transportation. On location they can be extended from the main unit on two opposite sides; this nearly triples the floor area. The additional units have rigid walls and are open to the main unit.

This type of container can be easily and well sealed with the help of corresponding seals. This is especially important for their use in the military sector. However, the disadvantage is that the floors of the main unit and the additional units—after they are extended—are not level. The current solution is to install floor plates with a corresponding height, especially in the main unit, after the additional units are extended. Apart from the fact that this restricts the useable height in the main unit, such a solution also prevents the installation of medical equipment, lockers or similar items.

The invention was charged with designing a container as described in the introduction so that the useable volume is restricted as little as possible and so that the installation of the container, together with its extended additional units, can be carried out faster and simpler.

According to the invention this requirement is fulfilled in that there is at least one lift device with which the respective additional unit can be lowered while or after it is extended so that the floors of the main and the additional unit are level and with which the respective additional unit can be lifted so that it can be reeled into the main unit. Preferably there should be a first and a second additional unit which can be extended on opposite sides of the main unit and for which there is a first respectively second lift device. The size of the second additional unit should be such that it can be reeled into the first additional unit whereby the second lift device is such that the second additional unit can be lifted high enough to be reeled into the second additional unit.

The principle of the invention is to use additional units with rigid floors which can be sealed well while and after they are extended from or reeled into the main unit and which can be produced easily with a sound structure. Lift devices ensure that the additional units are lifted before or while they are reeled into the main unit and, vice versa, ensure that, while the additional units are extended, they are lowered enough so that the floors of the main unit and the additional unit are in one plane.

In developing the invention further, we suggest installing telescopic guideways for every additional unit. These guideways can be in the form of rail carriers. We also suggest that the additional units have casters which roll over the guideways when the additional units are moved. A simple form of a lift device consists of the following: the guideways have slanted steps which drop to the outside and which lower the additional units while they are extended or lift them while they are reeled in. This can be accomplished by having slanted steps at the beginning and the end of each guideway and by the additional units having casters on the outside which are lower than the inside casters by the height of the inside slanted steps. This means that the respective additional unit is extended while it maintains its horizontal position and does not reach the two slanted steps until immediately before it reaches the final position. It then simultaneously rolls down over both these slanted steps.

An alternative is for the guideways to consist of carriers and rail elements whereby the rail elements can travel vertically through lift devices. Such lift devices can be distributed over the length of the rail elements and can be coupled via a common spindle pinion. It also is possible to connect the spindle pinions via a common primary shaft which preferably is located at the free ends of the guideways.

Another characteristic of the invention is for the lift device to have drop elements which make it possible to lower the respective additional unit due to gravity when it is rolled out. Additionally there is at least one resistance element which delays the drop movement of the additional unit.

The lift devices are such that the additional unit, which is extended out from the main unit all the way to a starting position, can be lowered from this position to the level of the final position of the additional unit via the drop elements without any manual activation. A special resistance element which essentially produces a resistance force which acts on the additional unit against the drop direction prevents the additional unit from accelerating while it is lowered so that there are only minor shocks when the final position is reached.

In accordance with the invention the resistance element can have a spring and especially an elastic coil spring. If the spring hardness and the length are adjusted to the anticipated load caused by the additional unit, then impacts are avoided when the additional unit is lowered. In addition it is advantageous to store energy in the spring when the additional unit is lowered. This energy can then be utilized when the additional unit is reeled back in. The lifting of the additional unit when it is reeled in, is supported by the effect of the spring.

The resistance element can also have a damping element, such as a frictional damper in the form of a gas pressure damper or an oil damper. This makes it possible to lower the additional unit smoothly.

In another model of the example there are telescopic guideways for every additional unit whereby the additional unit has casters which rolled over the guideways when the additional units are moved. The guideways have flexible end areas on the outside for lowering the additional units and are connected to at least one resistance element. The end areas of the guideways are drop elements and are a part of the lift device in accordance with the invention so that the additional unit, which rests on the end area with one caster, is lowered gently against the resistance of the resistance element which is connected to end area.

The resistance elements are located on or in the guideways whereby they preferably are in the longitudinal direction of the guideways. This ensures that the resistance elements do not require any additional space so that the lift device in accordance with the invention is especially compact.

In accordance with the invention the drop elements, which are located on the outside of the guideways, can be lowered from a horizontal starting position into an inclined final position whereby the end areas, in an advantageous manner, can swing downward. Such a design ensures that the casters on the bottom side of the additional unit reach the end areas via the horizontal guideways and from there are lowered into the final position by swinging the drop elements.

If the drop elements each have a stop for a caster of an additional unit on the outside, then the guideways advantageously are extended by the caster, which is at the stop, of the additional unit when the additional element is extended. This makes it possible to set up the container in a short period of time since the guideways do not have to be extended separately from the additional unit. Additionally, the stop accurately guides the additional unit during the drop process.

The weight of the respective additional unit and the characteristics of the resistance elements preferably are coordinated so that the respective drop elements essentially do not drop until a caster of the additional unit reaches the stop when the guideway is extended fully. The guideway together with the drop elements remains in the horizontal position until the additional unit is extended almost entirely from the main unit so that the floor of the additional unit remains in the horizontal position even while the container is being set up.

Taking the invention further, the drop elements are guided with drop mechanisms whose design ensures that the end areas carry out a combination of translational movements especially in downward direction and swing direction while they are being lowered. This can be achieved, for example, by equipping the drop mechanism with a combination of a sliding guide in longitudinal direction of the guideways as well as in drop direction of the additional unit and a hinge for swinging diagonally to the guideways in one direction. In accordance with the invention the drop mechanism is a connecting guide with a guiding groove each as well as a mobil form cam in the guiding groove. This design provides an exact kinematic connection between the translation and swinging of the drop elements which requires extensive construction in the model with the sliding guide and hinge. In a preferred model the form cam is attached to the drop element which can be horizontally swung while the guiding groove is located on the guideway.

In an especially preferred model of the connecting guide in accordance with the invention the cooperating guide surfaces of guiding groove and form cams each are partial segments of circular rings with corresponding radii. Such a connecting guide is especially easy to produce.

In another model of the invention the guidepaths have slanted steps which drop to the outside and which serve as drop elements for lowering the additional units. If then the connecting guide is such that a caster of the additional unit, which has reached the stop in the end area, carries out a movement when it is lowered which corresponds to the movement of at least one secondary caster of the additional unit in the area of a slanted step, the additional unit is lowered with an especially high degree of accuracy. Especially in a model in which there is a slanted step at the beginning of each guideway and in which the additional units have casters on the outside which are located lower than the inside casters by the height of the slanted step, the floor of the additional unit remains horizontal at all times while it is being lowered.

The invention requires that a resistance element is connected on one end with a guideway whereby a rope connection connects the drop element with the other end of the resistance element. This results in an especially simple design of the container in accordance with the invention.

Finally the invention requires that the lift device has a manual winch which is located between each additional unit and the main unit and which is used for reeling in the additional unit into the main unit. Such a winch makes it possible to reel the additional unit into the main unit without an excessive amount of force whereby especially in models with guideways with slanted steps the winch helps overcome the slanted steps. The winch can also be used for lowering the additional unit.

The invention is described in more detail in the drawings with the help of examples of different models.

Figure 1:
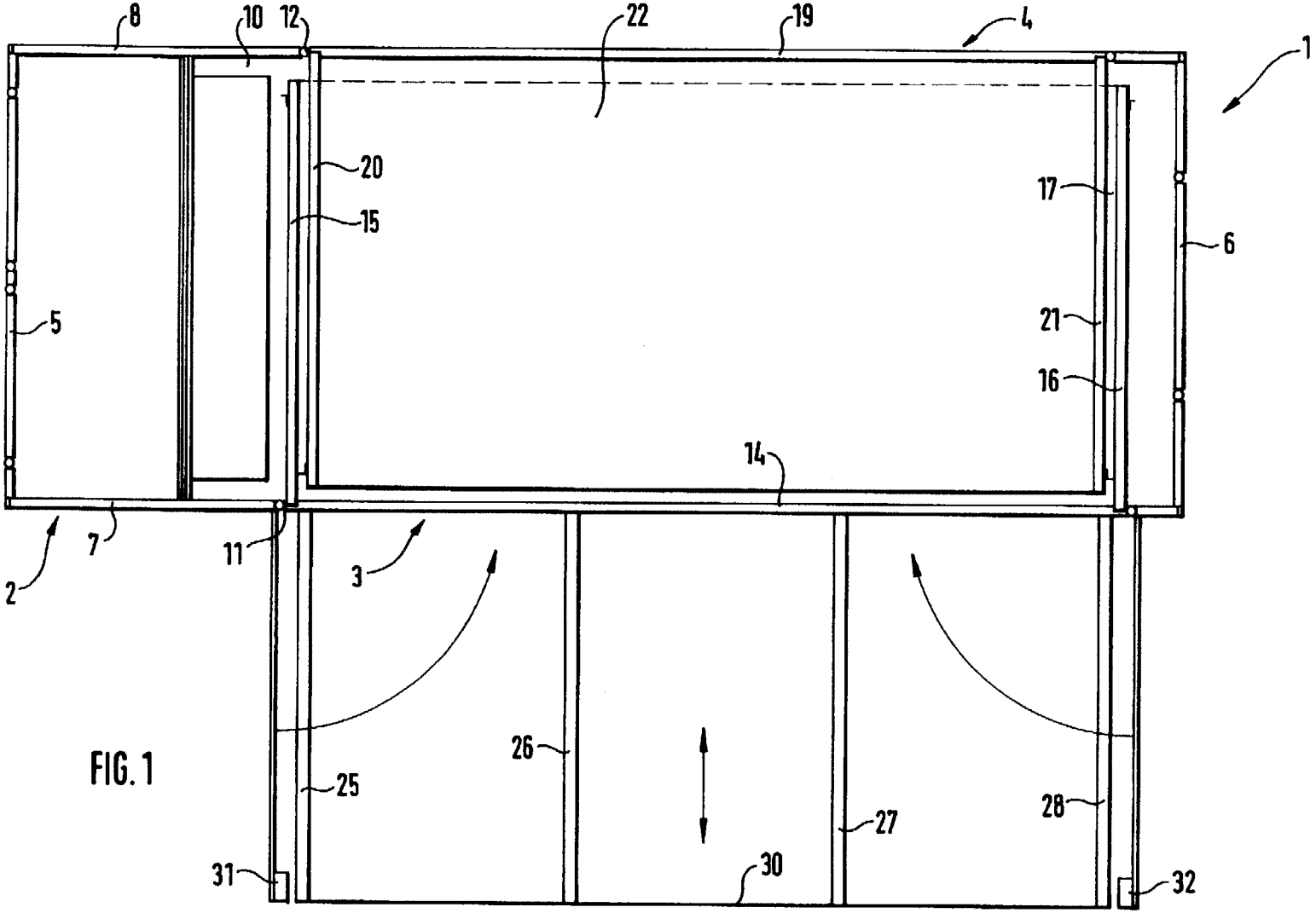
FIG. 1 shows a top view of a container in accordance with the invention without a roof.

Container 1 which is shown in FIGS. 1 through 5 has a rectangular main unit 2 as well as two additional units 3, 4. The main unit 2 has two face walls 5, 6, two side walls 7, 8, a ceiling 9 and a floor 10. The side walls 7, 8 have openings 11, 12 which are adjusted to the cross sections of the additional units 3, 4.

Figure 2:
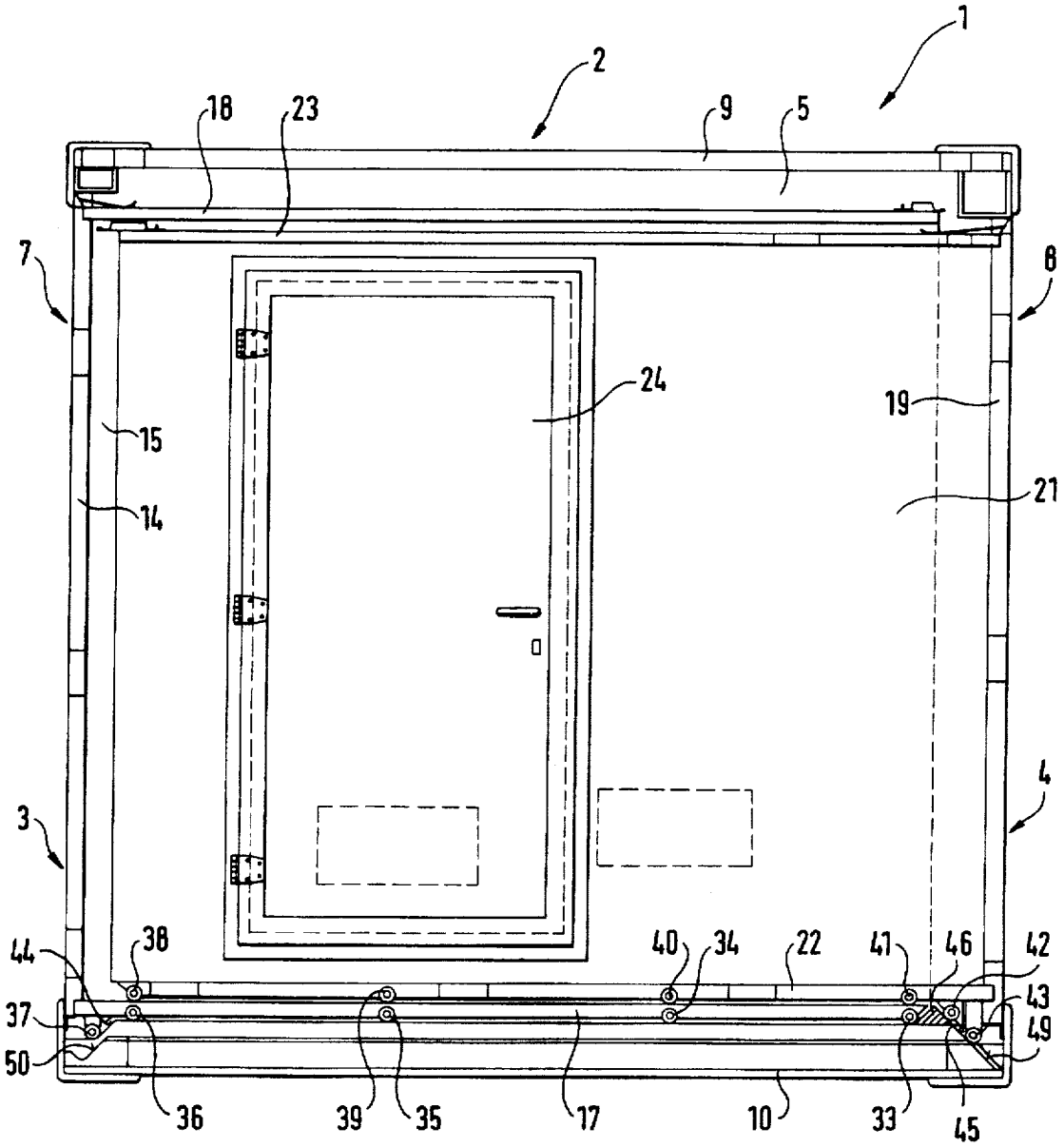
FIG. 2 shows a side view of the container in accordance with FIG. 1 but not face wall of the main and first additional unit and nested additional units.

The first additional unit 3 has a side wall 14, two opposing face walls 15, 16 as well as a floor 17 and a ceiling 18. The same applies to the second additional unit 4, i.e. here, too, there is a side wall 19, two opposing face walls 20, 21 as well as a floor 22 and a ceiling 23. The additional units 3, 4 are completely inside the main unit 2 during transportation of the container 1, as is shown in FIGS. 1 and 2, in a manner in which their side walls 14, 19 are flush with the side walls 7, 8 of the main unit 2. For this purpose the additional units 3, 4 are nested, i.e. the second additional unit 4 is inside the first additional unit 3. The dimensions of additional unit 4 are such that the unit just fits into the first additional unit 3. The second additional unit 4 has an entrance door 24 in its face wall 21.

Figure 3:
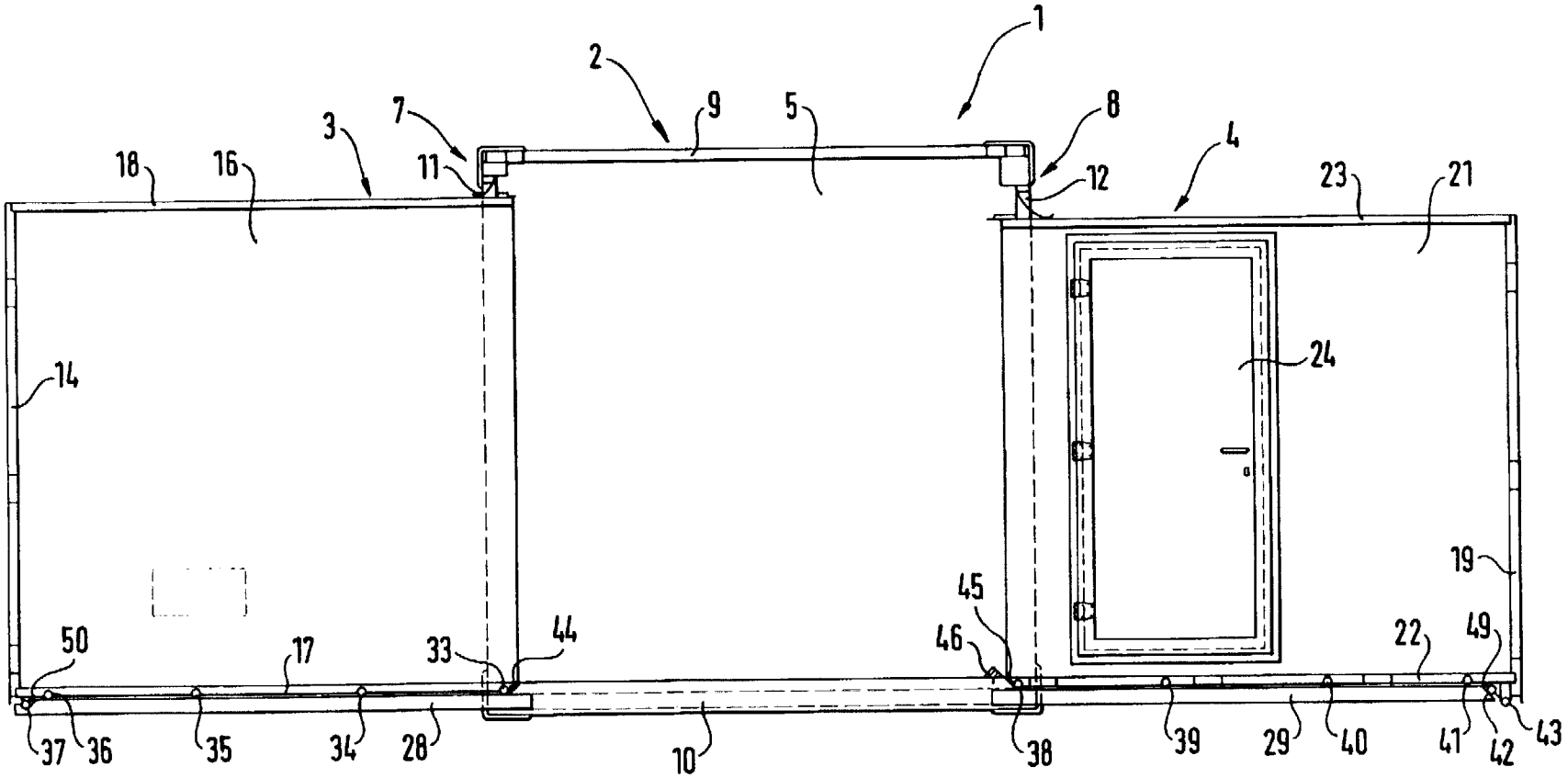
FIG. 3 shows the container in accordance with FIGS. 1 and 2 from the same viewpoint as FIG. 2 with extended additional unit.
Figure 4:
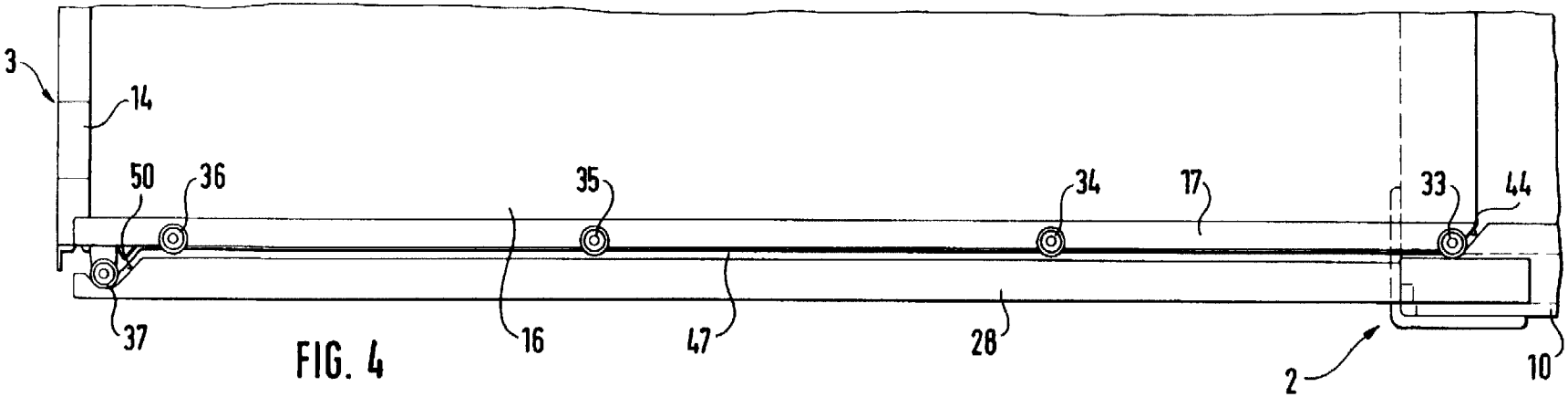
FIG. 4 shows a magnified picture of the rail guide of the left additional unit in FIG. 3.
Figure 5:
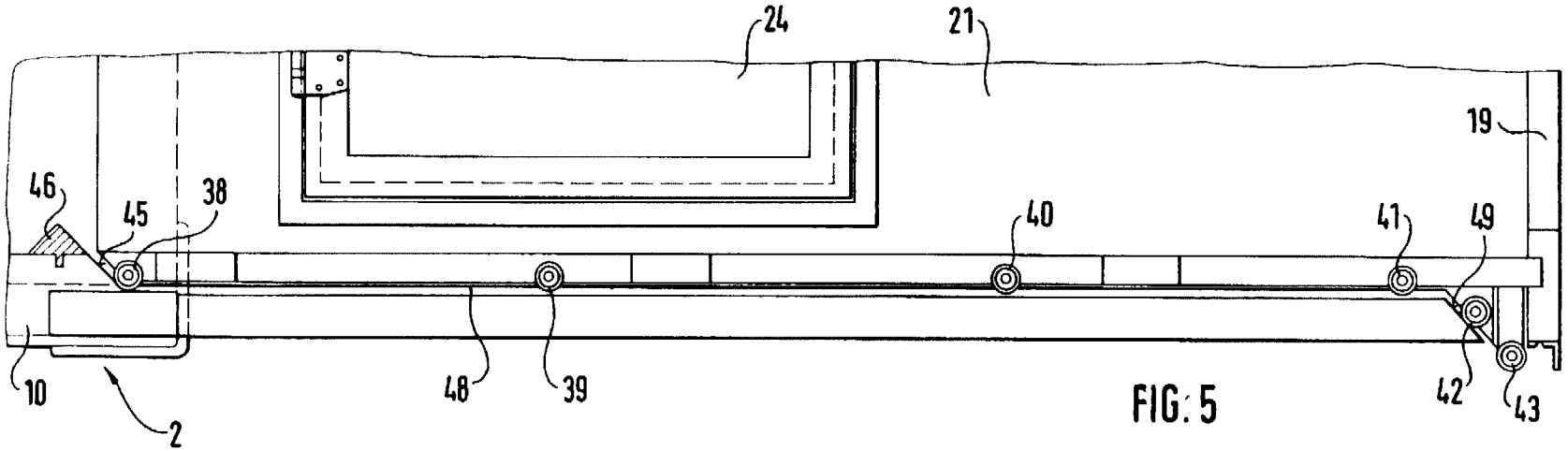
FIG. 5 shows a magnified picture of the rail guide of the right additional unit in FIG. 3.
Figure 6:
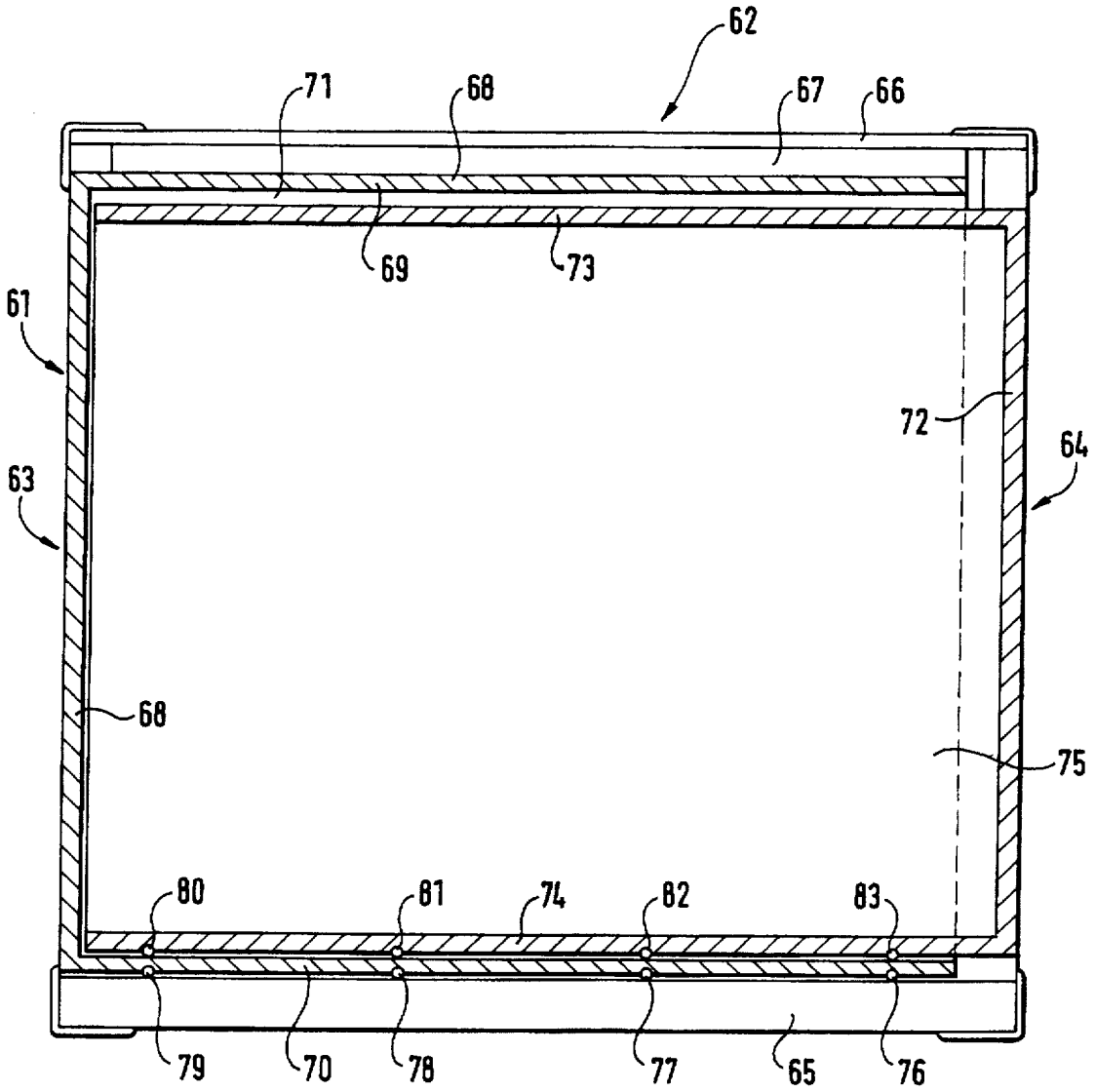
FIG. 6 shows the side view of a second model of the container in accordance with the invention without face walls and nested additional units.

There are guide rods in the floor of the main unit. These guide rods contain a telescopic rail system of which four extended rail carriers 25, 26, 27, 28 can be seen in FIG. 1 on one side. They are supposed to support the first additional unit 3 when it is extended. There is a corresponding rail system for supporting the second additional unit 4 which extends to the opposite side, as can be seen in FIG. 3. In this view the four rail carriers, of which only the front rail carrier 29 can be seen, are in consecutive order. The rail carriers of each side are connected via a connecting profile 30.

FIG. 1 also shows that the outermost rail carriers, 25, 28 are flanked by stabilization carriers 31, 32. They swivel around vertical axes in accordance with the arrows which are drawn in and assist as guides when the rail carriers 25, 26, 27, 28 are pulled out. They compensate the loads which act on the rail carriers 25, 26, 27, 28. This is why, under normal circumstances, it is not necessary to support and level the rail carriers 25, 26, 27, 28 towards the ground again. The stabilization carriers 31, 32, which fold out, ensure an exact parallelism between the telescopic rail carriers 25, 26, 27, 28 and the floor 10 of the main unit 2. At the same time the second additional unit 4 is guided on the side of the stabilization carriers 31, 32 when it is extended. It is understood that there are a corresponding stabilization carriers for the rail system on the opposite side.

The additional units 3, 4 are supported by caster systems on their bottom side. There is a caster system for every rail carrier 25, 26, 27, 28, 29 of which only one caster system is visible in each FIG. 2 through 5. The first additional unit 3 has four support casters 33, 34, 35, 36 for each caster system. The support casters 33, 34, 35, 36 are at the same level and at a distance from each other and are distributed almost over the entire width of the container 1. In addition there is an outer support caster 37 in the area of the side wall 14 which is somewhat lower than the other support casters 33, 34, 35, 36.

The second additional unit 4 also has four support casters 38, 39, 40, 41 per caster system which are distributed over its width and are at the same level. Additionally there are two outside support casters 42, 43 which are on a lower level than support casters 38, 39, 40, 41 whereby the outermost support caster 43 is on the lowest level.

On the outside the floor 10 of the main unit 3 is limited by declining slants 44, 45 in the area of its side walls 7, 8. In accordance with FIGS. 2 through 5 there also is a triangular rail 46 on the right side rests on the floor 10 and can be removed. Its right hand slanted surface continues the slant 45 of the floor 10—which also is a right hand slant—upward. The height of the triangular rail 46 corresponds to that of the floor 17 of the first additional unit 3.

Additional units 3, 4 are extended as follows: First the stabilization carriers 31, 32 are swung into the position indicated in FIG. 1. Then the rail carriers 25, 26, 27, 28, 29 on both sides are extended. They carry rails 47, 48. Then the second additional unit 4 is pushed out. Its support casters 38, 39, 40, 41 roll on the floor 17 of the first additional unit 3 while the outermost support casters 45 run on the rails 48. The difference of level between the upper edges of the rails 48 and the upper surface of the floor 17 of the first additional unit 3 corresponds to the difference of level between the outermost support casters 43 and the support casters 38, 39, 40, 41. In this manner the second additional unit 4 is extended horizontally at first, i.e. there are no jams.

Shortly before the end of the extension movement the second additional unit 4 is carried only by the outermost support casters 43 and the innermost support casters 38. The rail carriers 29 and therefore the rails 48 have slanted steps 49 on their outside ends which drop to the outside. The slanted steps 49 are reached by the outermost support casters 43 when the innermost support casters 38 are in front of the outside slant of the triangular rail 46 and the slant 45 of the floor 10. When the unit is extended more, the innermost support casters 38 roll over the triangular rail 46 and the slant 45 simultaneously and the outermost support casters 43 roll downward via the slanted steps 49. The consequence is that the second additional unit is lowered while its horizontal position is maintained and that the support casters 39, 40,41, 42 rest on rail 48. The height of the upper edge of the rails 48 is such that the unit is lowered enough to where the upper surfaces of the floors 10 of the main unit 2 and the floor 22 of the second additional unit are on the same level.

Now the first additional unit 3 can be extended whereby the outermost support casters 37 first support themselves on the rails 47 of the rail carriers 25, 26, 27, 28. The difference of level between the outermost support casters 37 and all other support casters 33, 34, 35, 36 corresponds to the difference of level between the upper edges of the rails 47 and the upper surface of the floor 10 of the main unit 2. The consequence is that the first additional unit 3 also is extended while its horizontal position is maintained. The rail carriers 25, 26, 27, 28 and the rails 47 which are on top of them, also have slanted steps 50 which drop towards the outside at their free ends whereby their distance to the slant 44 of the floor 10 is such that the innermost support caster 33 reaches the slant 44 and the outer support caster 37 reaches the slant 50 at the same time and both roll off at the same time. This causes the first additional unit 3 to drop until the support casters 33, 34, 35, 36 reach the rails 47. The height of the upper edge of the rails 47 is such that the unit is lowered to a level at which the upper surface of the floor 17 of the first additional unit 3 is at the same height as the upper surface of the floor 10 of the main unit 2.

After removing the triangular rail 46, there is a level floor which extends over both additional units 3, 4 and the main unit 2. Units which are designated for the main unit 2 but are installed in the second additional unit 4, for example an operating table, can be pushed into the main unit 2 and can be fastened there. This is accomplished via rails, which are not shown in detail here, and after a lock in additional unit 2 is loosened.

The additional units 3, 4 are pushed back into the main unit in reverse order. If devices are installed in the main unit 2, they are pushed into the second additional unit 4 via the rails described above and are fastened there. Then the triangular rail 46 is placed on the floor 10. Then the first additional unit 3 is moved into the main unit with the help of devices which are not shown in detail here. The slanted steps 50 and the slant 44 ensure that the first additional unit 3 is lifted to a level in which the support casters 33, 34, 35, 36 can roll onto the floor 10 of the main unit 2. The first additional unit 3 is reeled in when it is in the position indicated in FIG. 2.

Finally the second additional unit 4 is reeled in. Here, too, it is lifted by the support casters 42, 43 which roll onto the slanted steps 49 and the innermost support casters 38 which roll onto the slant 45 and then their extension in the form of the triangular rail 46 until the second additional unit 4 is inside the first and support casters 33, 34, 35, 36 can roll onto its floor 17.

It is understood that there are means for fastening the positions of the additional units 3, 4. Furthermore there are seals all around which seal the inside area of the container 1, even when the additional units 3, 4 are extended, from the outside atmosphere.

FIGS. 6 through 12 show a different container 61 with a similar design. Just like container 1 it has a rectangular main unit 62 and two additional units 63, 64. The main unit 62 corresponds to that of container 1 and has a floor 65, a ceiling 66, side walls, which cannot be seen in the drawing, as well as face walls 67. The side walls have openings for the additional units 63, 64.

The first and therefore larger additional unit 63 has a side wall 68, a ceiling 69, a floor 70 as well as two face walls 71 of which the one in front is cut off. The first additional unit 61 is open to the main unit 62. The second, smaller additional unit 64 also has a side wall 72, a ceiling 73, a floor 74 as well as two face walls 75 of which the one in front is cut off as well. In the cut transportation position shown in FIG. 6 the additional units 63, 64 are nested inside the main unit 62 whereby the side walls 68, 72 of the additional units 63, 64 are flush with the side walls of the main unit 62.

The first additional unit 63 rests over support caster systems, each of which consists of four support casters 76, 77, 78, 79 which are in a row in the direction of movement on the floor 65 of the main unit 62. The second additional unit 64 has corresponding support caster systems which each consist of four support casters 80, 81, 82, 83 whereby it rests over these support caster systems on the floor 70 of the first additional unit 63. Similar to container 1 in accordance with FIGS. 1 through 5 the floor 65 of the main unit 62 has four rail carriers on each side—vertical in a row to the plane of the drawing—whereby only the front rail carriers 84, 85 can be seen in FIGS. 6 and 7 as well as 12. The rail carriers 84, 85 are connected on each side on their outside ends via a unit profile 86, 87. The rail carriers 84, 85 are open to the top. Inside there are vertical rails 88, 89 which can be moved vertically. How this is done is explained in the description of FIGS. 9 through 12 below.

Figure 7:
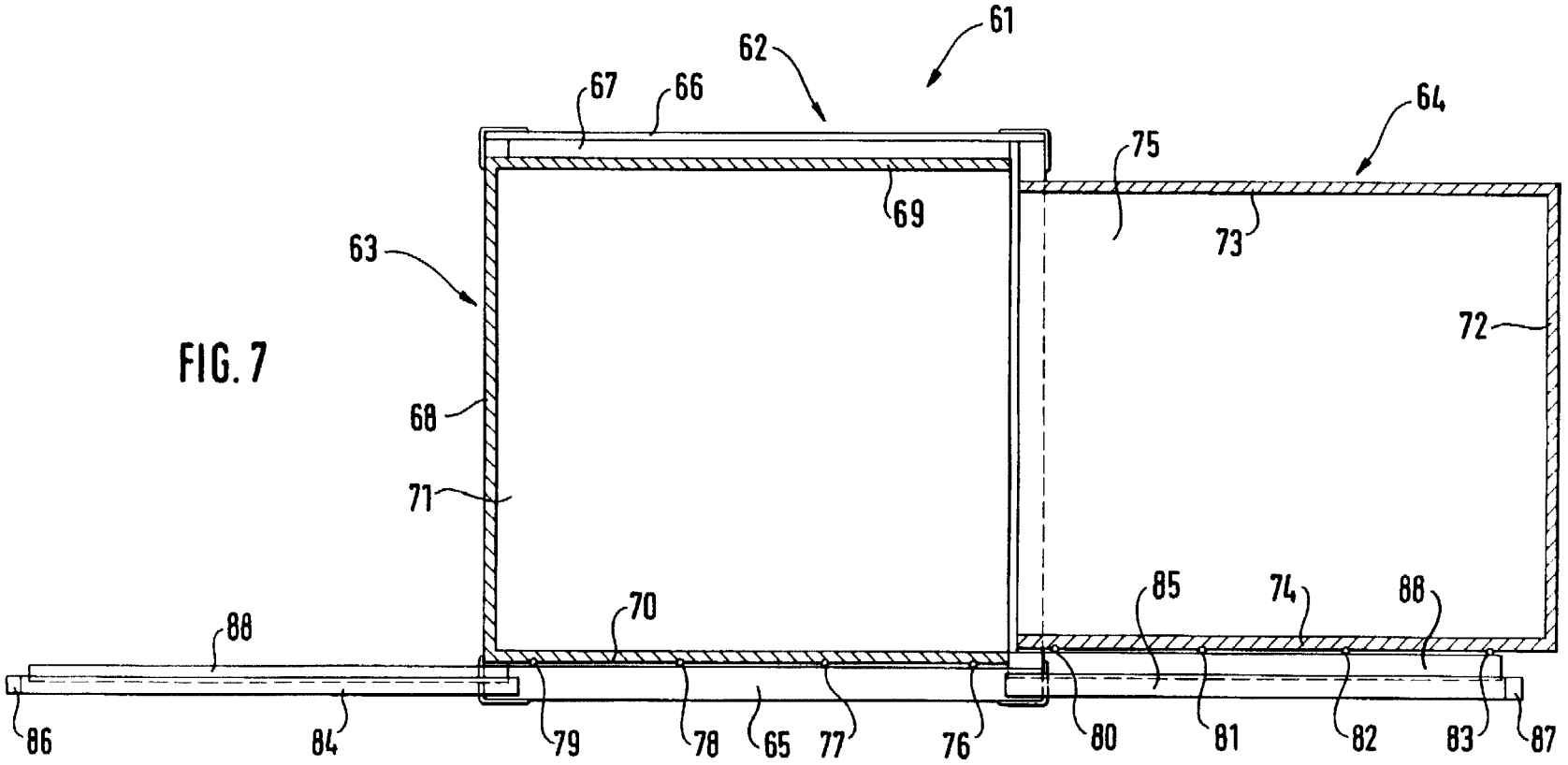
FIG. 7 shows the container in accordance with FIG. 6 with an extended additional unit.
Figure 8:
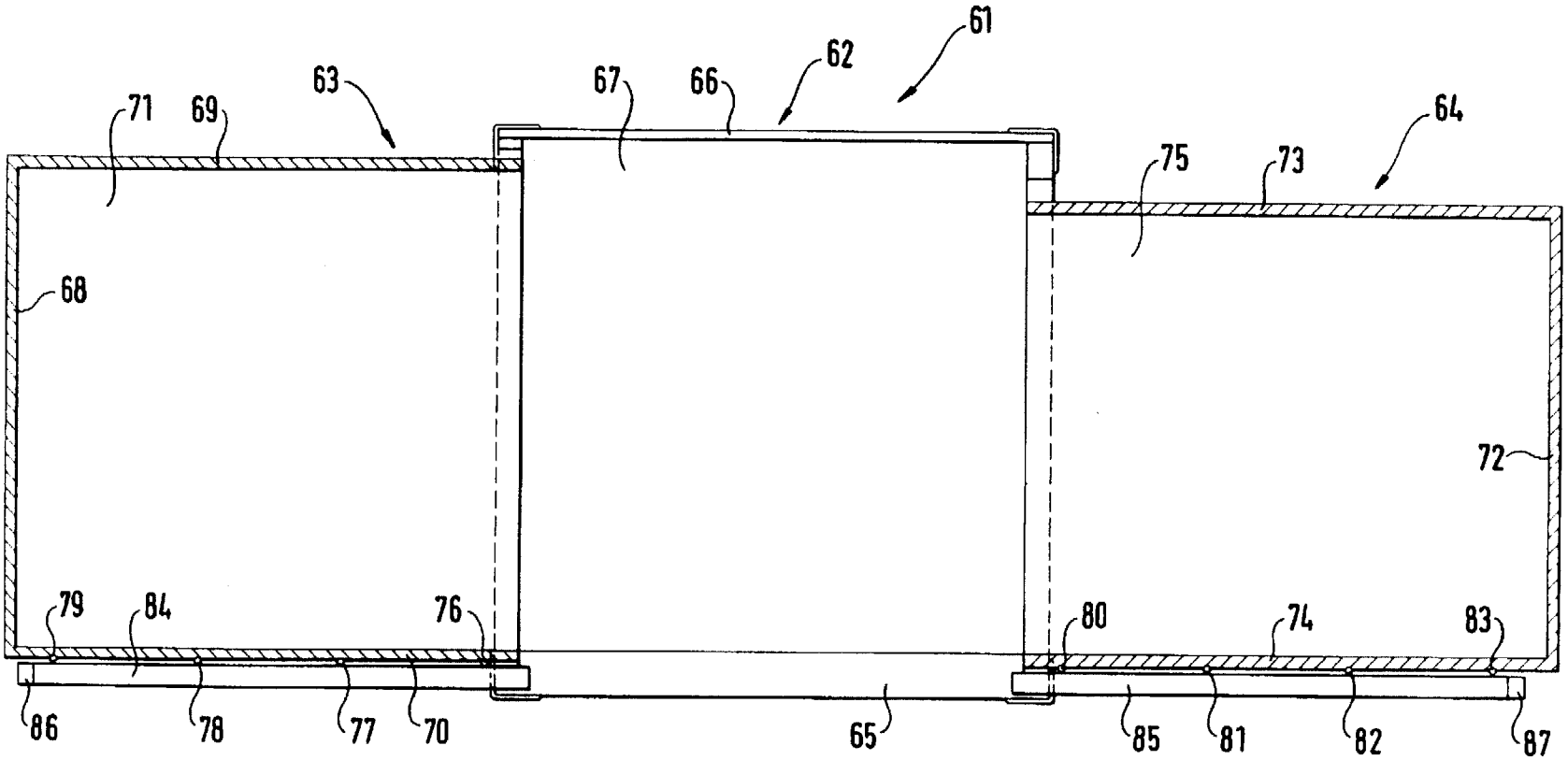
FIG. 8 shows the container in accordance with FIGS. 6 and 7 with extended additional units.
Figure 9:
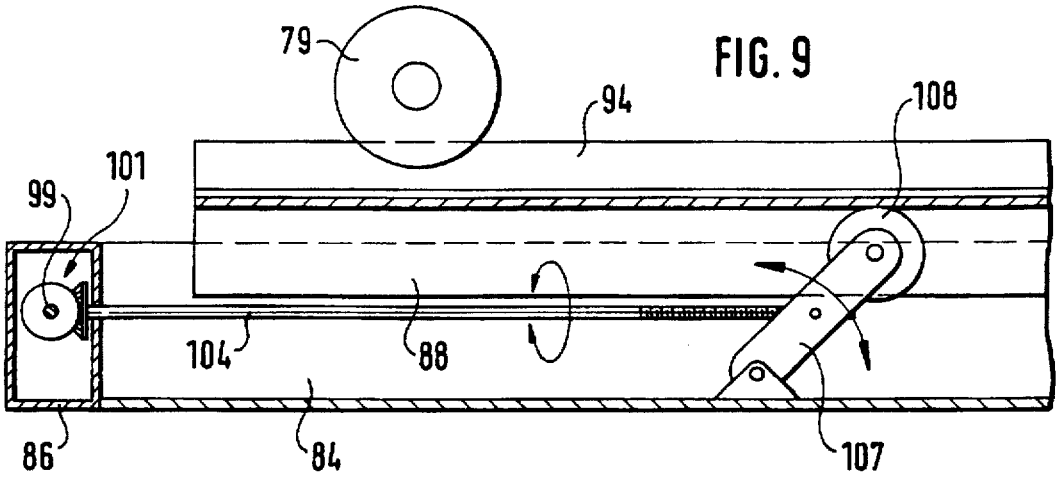
FIG. 9 shows a side view of a rail lift device.

FIG. 7 shows that the rail carriers 84, 85 are extended whereby the rails 88, 89 are in the uppermost position. The upper edge of the left hand rails 88 are on the same level as the upper surface of the floor 65 of the main unit 62. The right hand rails 89 are lifted higher so that their upper edges are on the level of the upper surface of the floor 70 of the first additional unit 63. In this position of rails 88 and 89 the second additional unit 64 can be extended into its final position. This scenario is illustrated in FIG. 7. The same can then be done with the first additional unit 63. After the final positions are reached, the rails 88, 89 are lowered into the rail carriers 84, 85 until the upper surfaces of the floors 70, 74 of the additional units 63, 64 reach the level of the upper surface of the floor 65 of the main element 62. The result is a floor Which is level across the entire width. This scenario is illustrated in FIG. 8.

The additional units 63, 64 are reeled back into the main unit in reverse order. First the rails 88, 89 are lifted to the level shown in FIG. 7. First all devices which could be installed to the floor 65 in the main unit 62 were pushed into the second additional unit 64 and fastened. Then the first additional unit 63 is reeled in so that the scenario illustrated in FIG. 7 is reached again. Then the second additional unit 64 can be reeled into the first additional unit 63. After the rails 88, 89 are lowered, the rail carriers 84, 85 are pushed into the floor 65 of the main unit 62 so that the container 61 returns to its original standard dimension and can be transported.

Apart from rail carrier 84 in FIGS. 9 through 12 there are two additional rail carriers 90, 91 with rails 92, 93. The rail carriers 84, 90, 91 have a U-profile open to the top in which the rails 88, 92, 93 reach as U-profiles open to the bottom with a superior rail track 94, 95, 96. There is a support caster 80, 97, 98 on each rail track 94, 95, 96.

A primary shaft 99 runs through the unit profile 86 which can be turned form the outside with the help of a crank 100. With the help of conical gear wheels 101, 102, 103 the movement of the primary shaft 99 is translated to spindle pinions 104, 105, 106 which are parallel to the axis inside the rail carriers 84, 90, 91. In the example shown in FIG. 9 the spindle pinion 104 acts onto a lever 107 via a spindle nut which is located on the floor of the rail carrier 84. The lever 107 has a lift caster 8 on its upper side which rests against the lower side of the rail 88. Depending on the direction of rotation of the spindle pinion 104, the lever 107 lifts or lowers whereby the rail 88 follows.

Figure 10:
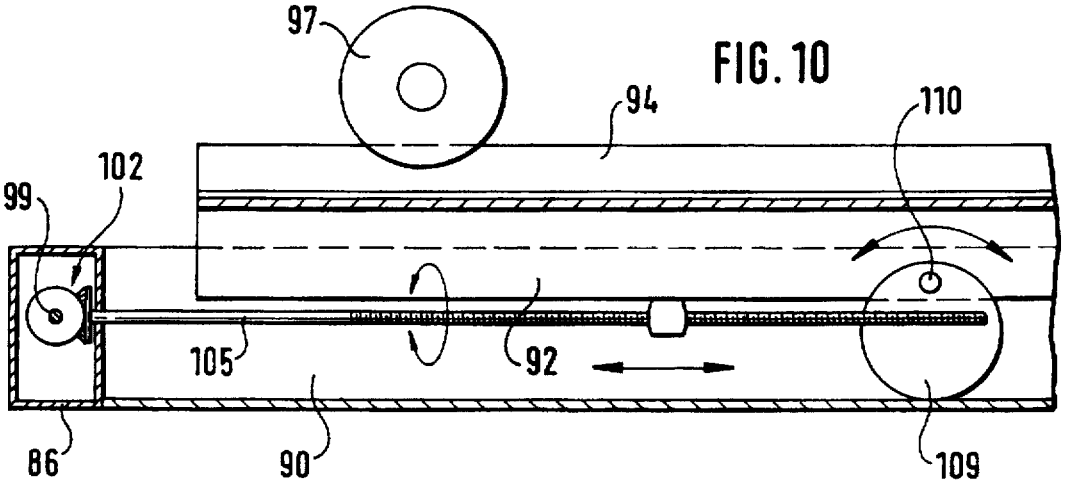
FIG. 10 shows a side view of a different rail lift device with a broken out section.
Figure 11:
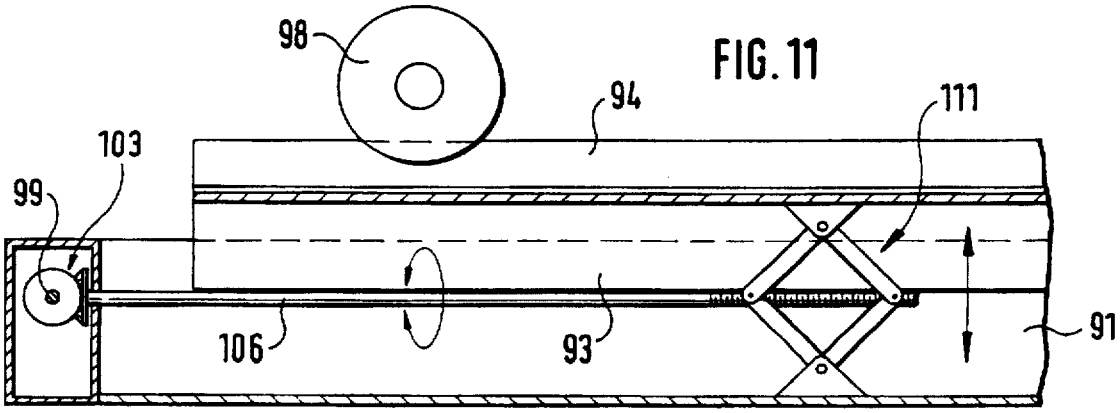
FIG. 11 shows a side view of another rail lift device with a broken out section.
Figure 12:
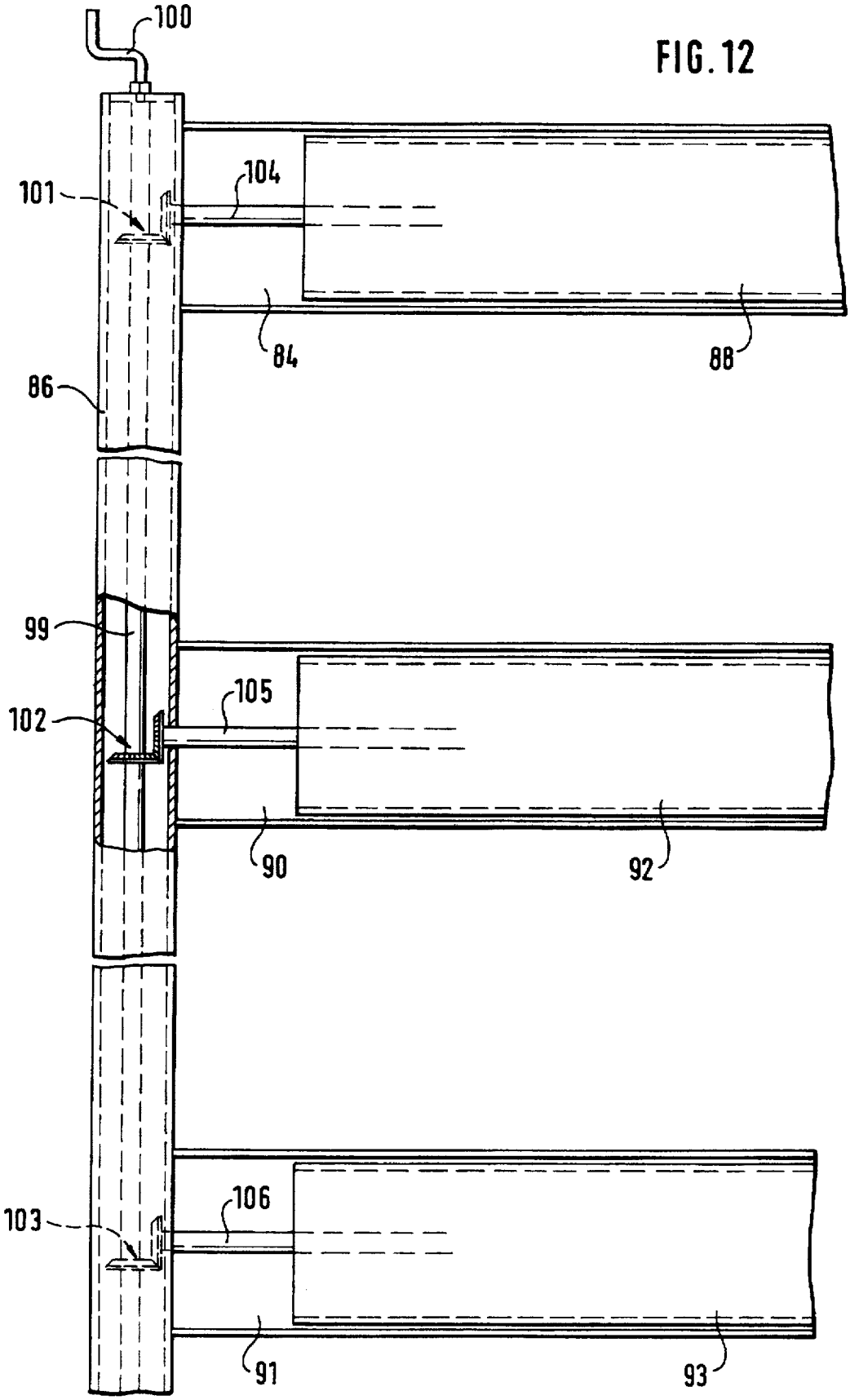
FIG. 12 shows a top view onto the rail lift device with broken out section.

In the example shown in FIG. 10 the spindle pinion 105 acts on a lift wheel 109 which rotates in the rail carrier 90 and puts it into a motion of rotation. The lift wheel 109 is connected with the flanks of the rail 92 via pins 110 located on both sides. The result is that a twisting of the lift wheel 109 caused by the spindle pinion 105, causes either an upward or downward movement of the rail 92, depending on the direction of rotation.

In the example shown in FIG. 10 the spindle pinion 106 acts on a scissor-type lifting device 111 which on one side supports itself against the floor of the rail carrier 91 and on the other side against the inside of the rail 93. Depending on the direction of rotation of the spindle pinion 106, the scissors are closed which causes the rail 93 to lift; or they open and the rail 93 drops.

It is understood that several of such lift devices are distributed over the length of the rail carriers 84, 90, 91 and that they are all activated by the spindle pinions 104, 105, 106. The different types of devices for lifting the rails 88, 92, 93 were only shown to illustrate the examples. It also is clear that there are only corresponding lift devices in correct models of the invention.

Figure 13:
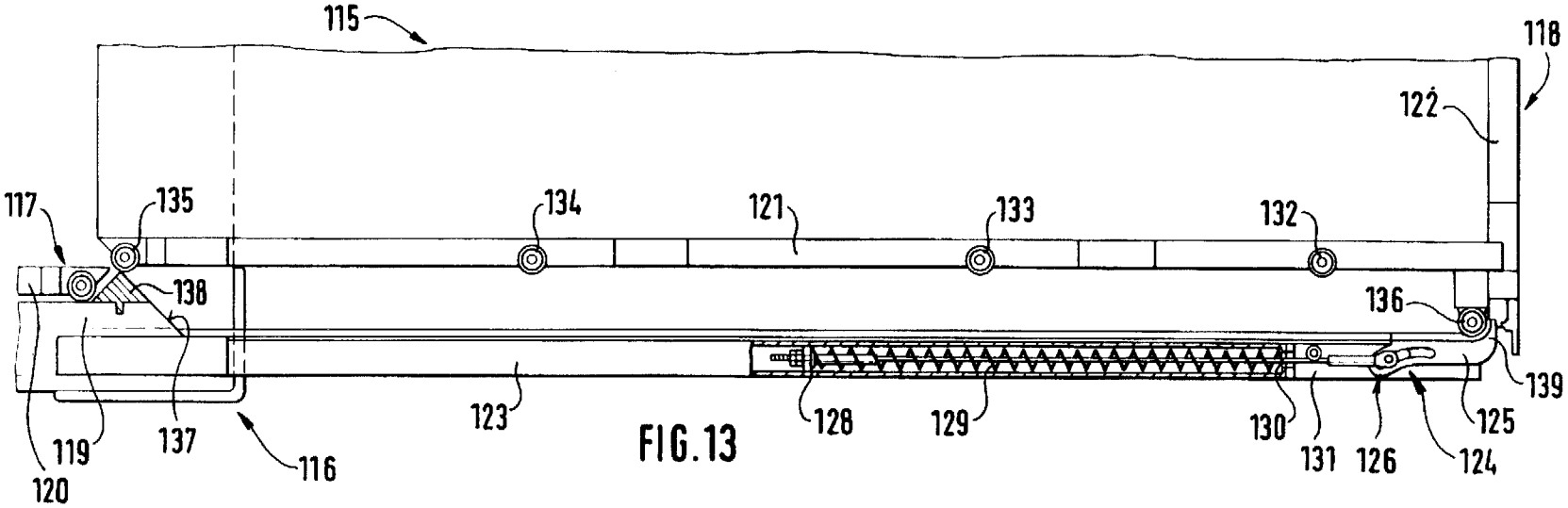
FIG. 13 shows a magnified illustration of the guideways of another right additional unit of a container in accordance with the invention, fully extended in a starting position before the additional unit is lowered.
Figure 14:
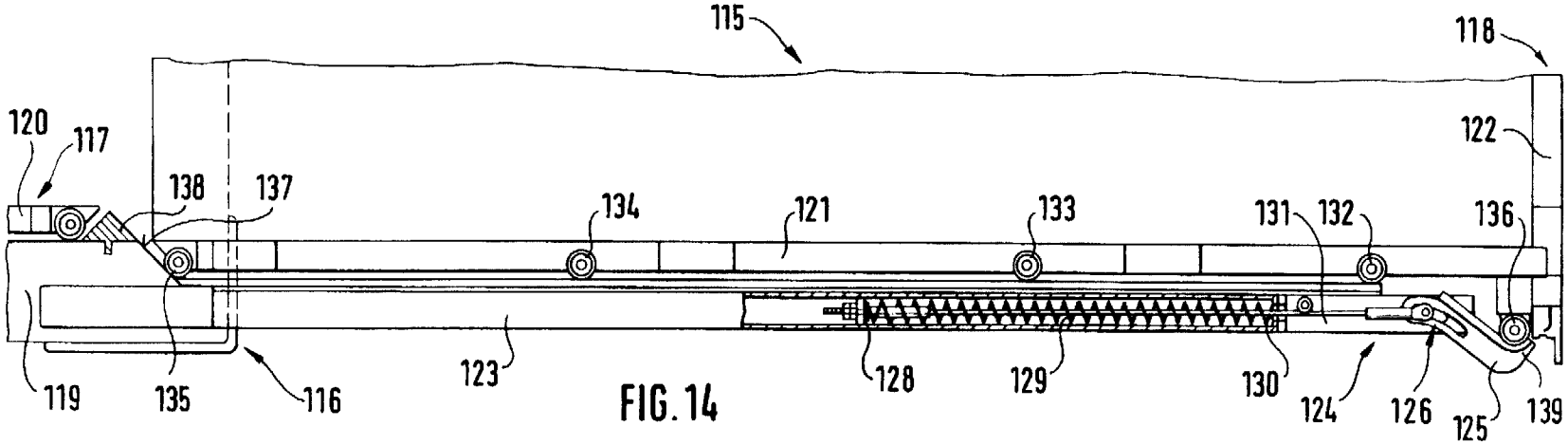
FIG. 14 shows a magnified illustration of the rail guide in accordance with FIG. 6 in a final position after the additional unit is lowered.
Figure 15:
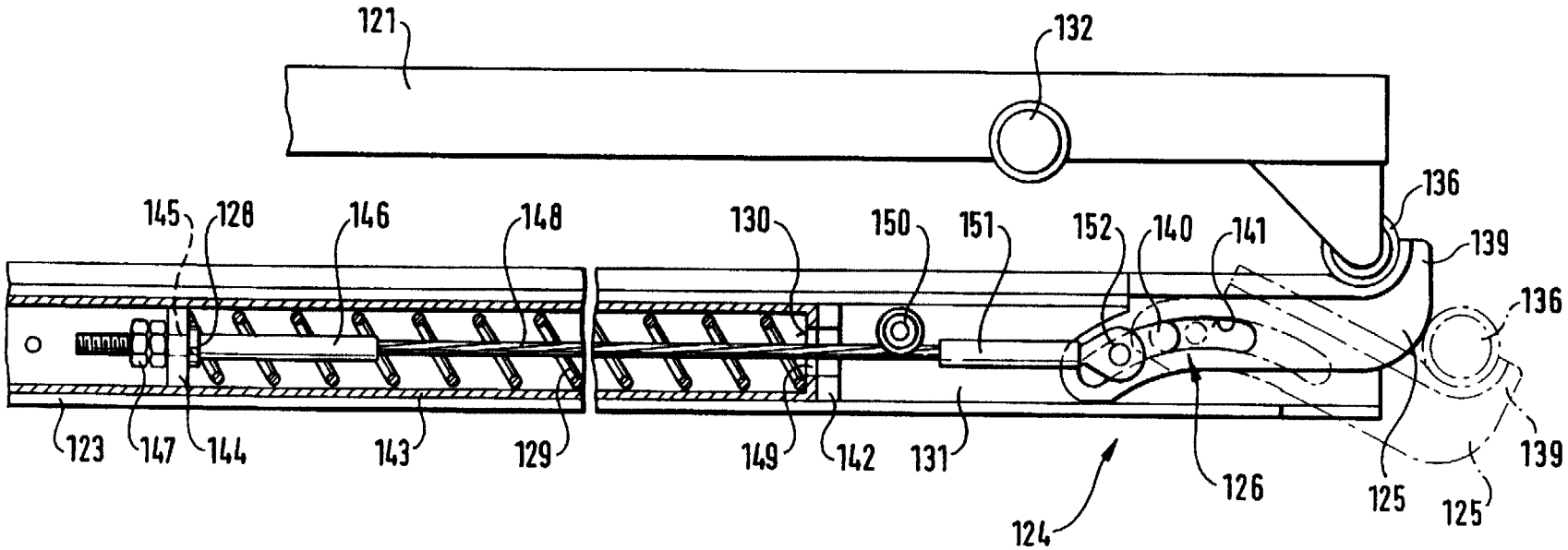
FIG. 15 shows a detailed illustration of the end area of the rail guide from FIGS. 6 and 7.

FIGS. 13 through 15 show parts of another container 115 in accordance with the invention. The container 115 has a rectangular main unit 116 as well as two additional units 117, 118. This illustration only shows the floor 119 of the main unit 116. It only shows a floor 120 of the first additional unit 117 while it shows a floor 121 as well as a face wall 122 of the second additional unit 118 are shown.

There are guiding rods in the floor 119 of the main unit 116. Inside these guiding rods there is a telescopic rail system for guiding and supporting the additional units 117, 118 during the extension process from the main unit 116. FIGS. 13 and 14 only illustrate the rail system for the second additional unit 118. The rail system for the second additional unit 118 has four rail carriers, arranged in succession in FIGS. 13 and 14, of which here only the foremost rail carrier 123 can be seen in its fully extended position.

At its end which faces away from the main unit 116 the rail carrier 123 has a return device 124. The return device 124 has a moveable end element 125 which pivots up and down in the rail carrier 123 via a connecting guide 126. Through a cable pull, which is not shown in this illustration, the end element 125 is connected to a first end 128 of a cylindrical coil spring 129, which is guided in the rail carrier 123. A second end 130 of the coil spring 129 supports itself against two side walls of the connecting guide 126 of which only one side wall 131 is shown in this illustration. In this manner it is possible to pivot the end element 125 downward against the effect of the compressing coil spring 129 from its position shown in FIG. 6 into the position shown in FIG. 7.

On its lower surface the second additional unit 118 is propped against caster systems. There is a caster system for every rail carrier 123 whereby FIGS. 13 and 14 only shown the caster system assigned to the first rail carrier 123. The second additional unit 118 has four support casters 132, 133, 134, 135 which are at a distance to one another on the same height level and which are distributed almost over the entire width of the additional unit 118. In addition there is an outer support caster 136 in the area of the side wall 122 which is a located a little lower than the remaining support casters 132, 133, 134, 135.

In the area of its end which faces the additional unit 118 the floor 119 of the main unit 116 is limited by a slant 137 which drops to the outside. In addition there is a removable triangular rail 138 on the upper surface of the floor 119 whose right hand slanted surface is the upward extension of the slant 137 which also is on the right hand side. The height of the triangular rail 138 corresponds to that of the floor 120 of the first additional unit 3 over the floor 119.

The additional unit 118 is extended from the main unit 16 with rail carriers 123 which are completely pushed into the main unit 116 as follows: If there are stabilization carriers for the rail carriers 123 on the main unit 116, they are pivoted out in the direction of the extension. Then the additional unit 118 is pushed out of the main unit 116. During this process the outer support caster 136 engages with a stop pin 139 located on the end element 125 so that the rail carrier 123 is extended when the additional unit 118 is pushed out. The support casters 132, 133, 134, 135 roll on the floor 120 of the first additional unit 117. The difference of level between the upper edges of the rail carriers 123 and the upper surface of the floor 120 of the first additional unit 117 corresponds to the difference of level between the outermost support casters 136 and the support casters 132, 133, 134, 135. In this manner the second additional unit 118 maintains its horizontal position while it is extended from the main unit 116 so that they do not jam.

Shortly before the end of the extension movement the second additional unit 118 is carried only by the outermost support casters 136 and the innermost support casters 135 as can be seen in FIG. 13. When the unit is extended further, the innermost support caster 135 rolls over the triangular rail 138 and the slant 137 downward. At the same time the end element 125 pivots downward into the position shown in FIG. 14 due to the load of the additional unit 118 as well as due the longitudinal force which is produced via the innermost support caster 135 on the triangular rail 138 and the slant in the direction of the rail carrier. The result is that the second additional unit 118 now is lowered while it maintains its horizontal position and that now support casters 39, 40, 41, 42 rest on the rail carrier 123. When the end element 125 is pivoted out from the position shown in FIG. 13 into the position shown in FIG. 14, the coil spring is compressed so that a larger force of resistance is exerted against the drop of the second additional unit 118 with the increasing drop. This means that the unit is dropped very gently. The coil spring 129 is adjusted so that the above decelerated drop movement can be carried out for a wide range of different weights.

The height of the upper edges of the rail carriers 123 is such that during the lowering process the upper surfaces of the floor 119 of the main unit 116 and the upper surface of the floor 121 of the second additional unit 118 reach the same level.

Now the first additional unit 117 can be extended whereby, after the triangular rail 138 is removed, the result is a level floor which extends over both additional units 117, 118 and the main unit 116.

The additional units 117, 118 essentially are reeled in in reverse order. First the triangular rail 138 is positioned on the floor 119 and the first additional unit 117 is pushed into the main unit 116. The first additional unit 117 is pushed in when it has reached the position shown in FIGS. 13 and 14.

Finally the second additional unit 118 is reeled in. For this purpose the second additional unit 118 receives a force from pull devices, which are not shown in detail and which exert a force one the main unit 116 so that the innermost support caster 135 moves from the position shown in FIG. 7 up the slant 137. This causes the second additional unit 118 to be lifted. This movement is supported by the spring force of the coil spring 129 which acts on the end element 125 whereby the effect of the force affects the outer support caster 136 via the stop pin 139 and is introduced into the second additional unit 118. The special form of the connecting guide 126 ensures that—while the additional unit 118 moves up and down—the outer support caster 136 is guided so that the floor 121 remains mostly parallel with the support caster 135 which moves upward via the slant 137 and the triangular rail 138 toward the left to the upper surface of the floor 119 of the main unit 116.

As soon as the innermost support caster 135 has moved the uppermost edge of the triangular rail 138, the end element 125 is back in its starting position shown in FIG. 13. Then the additional unit 118 is rolled into the main unit 116 on the innermost support caster 136 and on the outermost support caster 136 whereby the outer support caster 136 rolls on the rail carrier 123. After the second additional unit 118 is pushed in all the way, the rail carriers 123 are pushed into the floor 119 of the main unit 116 which brings the container 115 into transport position.

It is understood that there are devices for fastening the positions of the additional units 117, 118 as well as fastening the rail carriers 123 in the reeled in state. Furthermore there are O-ring type seals which keep the inside of the container 115 sealed against the outside atmosphere even while the additional units 117, 118 are extended.

FIG. 15 shows a detailed illustration of the end area of the rail carrier 123 with the moveable end element 125 whereby it is shown in the starting position shown in FIG. 13 as well as in the swung position shown in FIG. 14.

The connecting guide 126 has a form cam 140, which is well visible from this viewpoint, in the form of a circular arc segment which is rounded at its ends and which is formed on the side wall 131. On the form cam 140 there is a guiding groove 141 which also has a circular arc profile and which is located in part of the end element 125. When the end element 125 is pivoted it moves over the form cam 140 by moving the guiding groove so that it carries out a translational movement directed diagonally downward and to the right as well as a pivoting movement around an axis vertical to the drawing plane. The pivoting movement of the end element 125 is such that the outermost support caster 136 which rests against the stop pin 139 essentially carries out the same movement as the innermost support caster 135 which rolls over the triangular rail 138 and the slant 137. On its upper surface the shape of the end element 125 is such that it is flush with the upper surface of the rail carrier 123 so that when the second additional unit 118 is pushed into the main unit 116, the outermost support caster 36 which rolls on the upper surface of the end element 125 can roll onto the upper surface of the rail carrier 123 without any jolts.

In order to obtain a stiffer connecting guide 126 there is a second side wall, which is not shown, whose form essentially corresponds to that of the first side wall 131 and which is connected with it via the form cam 140, distance sleeves, which are not shown in this illustration, as well as a base plate 142.

The base plate 142 is followed by a guiding rod 143 for the coil spring 129. The coil spring 129 is inserted in the guiding rod 143 whereby its second end 130 rests against the base plate 142. A sliding limit stop washer 144 is inserted into the guiding rod 143 at the first end 128 of the coil spring 129. The limit stop washer 144 has a through hole 145 through which the end of the thread of a grommet 146 is guided whereby there are two counter nuts 147 on the limit stop washer 144 on the side which faces away from the coil spring 129 on one end of the grommet 146. There is a cable pull 148 on the other end of the grommet 146 which is guided through a longitudinal hole 149 in the base plate 142 via a guide pulley 150 on the side wall 131 and which discharges into an eye bracket 151 with an eye hole 152. Through a pin, which is not shown and which runs through the eye hole 152, the eye bracket 151 is connected with the back end of the end element 125. The length of the cable pull 148 is adjusted by the counter nuts 147 so that the coil spring 129, when the end element 125 is in the starting position in accordance with FIG. 13, experiences a slight pre-stress.

If the end element 125 is swung downward, as is done by lowering the second additional unit 118 described in FIGS. 13 and 14, the eye hole 152 of the eye bracket 151 moves to the right in the drawing. This moves the cable pull 148 and with it the limit stop washer 144 to the right which compresses the coil spring 129 even more. When the end element 125 is released it springs back into its starting position due to the force of the coil spring 129. Since the eye bracket is not only moved in the direction of the longitudinal carrier 123 but is also moved diagonally upward when the end element 125 is swung, the deviation of the cable pull 148 on the guide pulley 150 guarantees that the cable pull 148 in the area of the coil spring 129 always is essentially parallel to its symmetrical axis so that frictional contact between the cable pull 148 and the base plate 142 inside the longitudinal hole 149 as well as a jamming of the limit stop washer 144 in the guiding rod 143 is avoided.

The connecting guide 126 is connected with the rail carrier 123 via a screw connection, which is not shown in detail in this illustration, through the side walls 131. When the connecting guide 126 is replaced, e.g. when the coil spring 129 is to be replaced by a coil spring with a different hardness, the screw connections between the side walls 131 and the rail carriers 123 are loosened which now makes it possible to pull out the connecting guide 126 together with the guiding rod 143 and the components for the connecting guide 126 and the guiding rod 143 especially when the additional unit 118 and the rail carrier 123 are pushed into the main unit 116.

Figure 16:
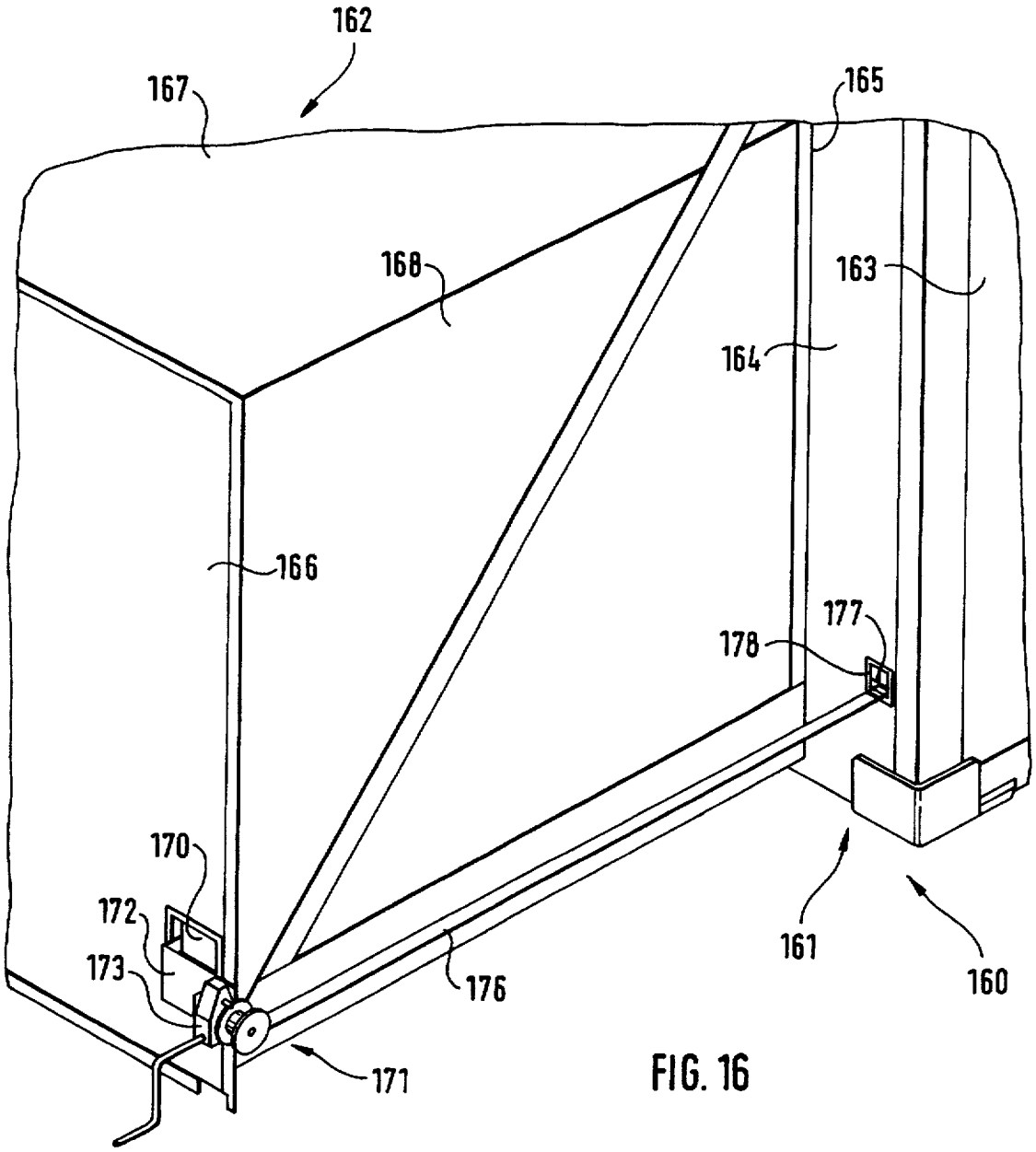
FIG. 16 shows a magnified illustration of yet another container in accordance with the invention with a winch for reeling in the extended additional unit.

FIG. 16 shows a magnified illustration of another container 160 in accordance with the invention which has a similar structure as containers 1 and 115. It has a rectangular main unit 161 and two additional units of which only the first additional unit 162 is shown. The main unit 161 has a floor, which is not shown, a ceiling which is not shown, face walls of which only the front face wall 163 is shown as well as side walls of which only the side wall 164 which faces to the first additional unit 162 is shown in this illustration. The side wall 164 has an opening 165 for the first additional unit 162.

The first additional unit 162 has a side wall 166, a floor, which is not shown, a ceiling 167 as well as two face walls of which only the front face wall 168 can be seen.

In this illustration the first additional unit 162 is extended from the main unit 161. In the area of the edges between the side wall 166 and the front face wall 168 there is winch 171 at the lower end of the side wall 166 in a designated receptacle 170. The winch 171 has a base plate 172 which follows the receptacle 170 and on which the winch gears 173 are fastened. The which gears 173 have a crank handle 174 at the entrance and a conveyor drum 175 at the exit. The conveyor drum 175 has a tie member 176 whereby the illustration shows that the tie member 176, which has a draw hook 177 at its free end, is unwound partially and is tightened towards the main unit 161. There the draw hook 177 engages into a hook receptacle 178 in the side wall 164 whereby in the illustration the tie member 176 is tightened by turning the crank handle 174. On the edge between the side wall 166 and the back face wall of the first additional unit 162 there is a second winch which also is not shown here and which is identical to winch 171.

In order to push the first additional unit 162 into the main unit 161 both winches are operated simultaneously which causes the tie member 176 to roll up on the conveyor drum 175 and thus pulls the side wall 166 of the first additional unit to the side wall 164 of the main unit 161. When the first additional unit 162 is completely pulled in, the draw hook 177 is unhooked from the hook receptacle 178 and the winch 171 is removed from the receptacle 170.

We claim:

1. A container (1, 61, 115, 116), especially used as working or living space, with a main unit (2, 62, 116, 161) and at least one additional unit (3, 4, 63, 64, 117, 118, 162) with one side which is open to the main unit (2, 62, 116, 161) whereby said at least one additional unit (3, 4, 63, 64, 117, 118, 162) can be extended from and reeled back into the main unit (2, 62, 116, 161), such that a floor of said at least one additional unit remains planar when extended from and reeled back into the main unit, is characterized in that there is at least one lift device each (44, 45, 49, 50, 107, 108, 109, 110, 111, 124, 137) operably associated with said container and said additional unit, said lift device comprising at least first and second parallel rails extensible from said container and a plurality of rotary members carried by said additional unit and engageable with and movable along said rails, through which said at least one additional unit (3, 4, 63, 64, 117, 118, 162) can be lowered so that the floors (10, 17, 22, 65, 70, 74, 119, 120, 121) of the main and said at least one additional unit (2, 3, 4, 62, 63, 64, 116, 117, 118, 161, 162) are on the same level and through which said at least one additional unit (3, 4, 63, 64, 117, 118, 162) can be lifted so that said at least one additional unit can be reeled into the main unit (2, 62, 116, 161).

2. The container in accordance with claim 1 is characterized in that there is a first and a second additional unit (3, 4, 63, 64, 117, 118, 162) which can be extended on opposite sides of the main unit (2, 62, 116, 161) and for which there is a first respectively second lift device each (44, 45, 49, 50, 107, 108, 109, 110, 111, 124, 137).

3. The container in accordance with claim 2 is characterized in that the dimensions of the second additional unit (4, 64, 118) are such that it can be reeled into the first additional unit (3, 63, 117, 162) whereby the second lift device is such that it can lift the second additional unit (4, 64, 118) until it can be reeled into the first additional unit (3, 63, 117, 162).

4. The container in accordance with claim 1 is characterized in that there are telescopic guideways (25, 26, 27, 28, 29, 84, 85, 90, 91, 123) for every additional unit (3, 4, 63, 64, 117, 118, 162) and that the additional units (3, 4, 63, 64, 117, 118, 162) have casters (33 through 43, 76 through 83, 97, 98, 132, 133, 134, 135) which roll on the guideways (25, 26, 27, 28, 29, 84, 85, 90, 91, 123) when the additional units (3, 4, 63, 64, 117, 118, 162) are moved.

5. The container in accordance with claim 4 is characterized in that the guideways (25, 26, 27, 28, 29, 123) have slanted steps (44, 45, 49, 50, 137) which drop to the outside and which serve as lift devices for lowering the additional units (3, 4, 17, 118) when they are extended and for lifting them when they are reeled in.

6. The container in accordance with claim 5 is characterized in that at the beginning and at the end of every guideway 25, 26, 27, 28, 29, 123) there are slanted steps (44, 45, 49, 50, 124, 137) and that the additional units (3, 4) have casters on the outside (37, 43, 136) which are lower by the height of the respective inside slanted step (44, 45, 137) than the inside casters (33, 34, 35, 36, 38, 39, 40, 41, 135).

7. The container in accordance with claim 4 is characterized in that the guideways consist of carriers (84, 85, 90, 91) and rail elements (88, 89, 92, 93) whereby the rail elements (88, 89, 92, 93,) can be moved vertically via the lift devices (107, 108, 109, 110, 111).

8. The container in accordance with claim 7 is characterized in that the lift devices (107, 108, 109, 110, 111) are distributed over the length of the rail elements (88, 89, 92, 93) and are coupled via a common spindle pinion (104, 105, 106).

9. The container in accordance with claim 8 is characterized in that the spindle pinions (104, 105, 106) are connected via a common primary shaft (99).

10. The container in accordance with claim 9 is characterized in that the primary shaft (99) is located on the free ends of the guideways (84, 85, 90, 91).

11. The container in accordance with claim 4 is characterized in that the guideways form guide rails.

12. The container in accordance with claim 4 is characterized in that the guideways (25, 26, 27, 28, 29, 84, 85, 90, 91) are connected on the outside.

13. The container in accordance with claim 1 is characterized in that the lift device (125, 135, 137, 138) has drop elements (125, 137, 138) which, when the respective additional unit (118) rolls on, make it possible to drop the unit due to gravity and whereby there is at least one resistance element (129) for delaying the drop movement of the additional unit (118).

14. The container in accordance with claim 13 is characterized in that the resistance element has a spring, especially an elastic coil spring (129).

15. The container in accordance with claim 13 is characterized in that the resistance element has a damping element.

16. The container in accordance with claim 13 is characterized in that there are telescopic guideways (123) for each additional unit (118), that the additional units (118) have casters (132, 133, 134, 135, 136) which, at least partially, roll on the guideway (123) when the additional unit (118) is moved and that the guideways (123) have end areas on the outside as drop elements (125) whereby one drop element (125) each is connected with at least one resistance element (129).

17. The container in accordance with claim 16 is characterized in that the resistance element (129) respectively the resistance elements are located on or in the guideways (123).

18. The container in accordance with claim 16 is characterized in that the resistance element (129) respectively the resistance elements are located in the longitudinal direction of the guideways (123).

19. The container in accordance with claim 16 is characterized in that the drop elements (125) can be lowered from a horizontal starting position into a final position which is slanted downward.

20. The container in accordance with claim 16 is characterized in that the drop elements (125) can pivot downward.

21. The container in accordance with claim 16 is characterized in that the drop elements (125) have a stop (139) on the outside for a caster (136) of an additional unit (118).

22. The container in accordance with claim 21 is characterized in that the weight of the respective additional unit (118) and the characteristics of the resistance element (129) are matched so that the respective drop elements (125) essentially do not drop until a caster (136) of the additional unit (118) reaches the stop (139) when the unit is fully extended.

23. The container in accordance with claim 16 is characterized in that the drop elements (125) are guided with drop mechanisms (126) which are designed so that the drop elements (125) carry out a combination of a translational movement and a pivoting movement when they are lowered.

24. The container in accordance with claim 23 is characterized in that the drop mechanisms are connecting guides (126) with a guiding groove (141) which have a form cam (140) which moves in the guiding groove (141).

25. The container in accordance with claim 24 is characterized in that the cooperating guide surfaces of guiding groove (141) and form cams (140) are partial segments of circular rings with matching radii.

26. The container in accordance with claim 16 is characterized in that at the beginning of at least one guideway (123) there is a slanted step (137, 138) which drops to the outside and serves as drop element for lowering the additional unit (118) and that the additional unit(s) (118) have casters (136) on their outside which are located lower by the height of the slanted step (137, 138) than the inside casters (132, 133, 134, 135).

27. The container in accordance with claim 21 is characterized in that the guideways (123) have slanted steps (137, 138) which drop to the outside and which help lower the additional unit (118) whereby the connecting guide (126) is such that a caster (136) of the additional unit (118) which is at the stop (139) carries out a movement when it is lowered which essentially corresponds with the movement of a caster (135) which rolls in the area of a slanted step (137, 138).

28. The container in accordance with claim 16 is characterized in that one resistance element (129) each is connected on one end (133) with a guideway (123) and that the cable pull (148) is used to connect a drop element (125) with the other end (128) of the resistance element (129).

29. The container in accordance with claim 13 is characterized in that the lift device has a manual winch device (171) which is located between the additional unit (162) and the main unit (161) which above all is used to reel in the additional unit (162) into the main unit (161).

30. An expandable container for use as a working or living space, comprising:

a. a main unit;

b. at least one additional unit operably associated with said main unit such said at least one additional unit can be extended from and reeled back into the main unit, said at least one additional unit includes a floor that remains planar when reeled back into said main unit; and c. at least one lift device operably associated with said container and said additional unit, said lift device comprising at least first and second parallel rails extensible from said container and a plurality of rotary members carried by said additional unit and engageable with and movable along said rails, such that said at least one additional unit can be lowered so that floors of the main unit and said at least one additional unit are on the same level.

* * * * *